United States Patent [19]

Walker

[11] 4,279,097

[45] Jul. 21, 1981

[54] SOFT PLAYING DISC

[76] Inventor: Gary W. Walker, 3475 Chartered Oak Dr., Carlsbad, Calif. 92008

[21] Appl. No.: 155,495

[22] Filed: Jun. 2, 1980

[51] Int. Cl.[3] ..... A63H 27/00; B32B 3/02; A42B 1/02

[52] U.S. Cl. ..... 46/74 D; 2/200; 273/424; 428/88

[58] Field of Search ..... 46/74 D; 2/192, 196, 2/200, 195; 428/85, 88; D6/209, 210, 213; 273/424, 425

[56] References Cited

U.S. PATENT DOCUMENTS

| | | | |
|---|---|---|---|
| 1,125,076 | 1/1915 | Dorr | 273/424 |
| 2,616,092 | 11/1952 | Berg | 2/200 |
| 3,293,796 | 12/1966 | Strader | 428/85 |
| 3,985,089 | 10/1976 | Yacono | 428/88 |
| 4,054,698 | 10/1977 | Hamrah | 428/88 |
| 4,115,946 | 9/1978 | Vukmirovich | 46/74 D |
| 4,201,009 | 5/1980 | Burridge, Jr. | 46/74 D |

*Primary Examiner*—Robert Peshock
*Assistant Examiner*—Michael J. Foycik, Jr.
*Attorney, Agent, or Firm*—Brown & Martin

[57] ABSTRACT

A soft playing disc is made of a pliable material having a generally disc-cupped shape to provide an aerodynamically stable disc. The material from which the disc is constructed is sufficiently rigid to enable the device to maintain and hold an aerodynamically stable structure and yet is sufficiently soft and resilient to prevent or avoid damage or injury should it strike an individual.

4 Claims, 3 Drawing Figures

SOFT PLAYING DISC

BACKGROUND OF THE INVENTION

The present invention relates to games and toys and pertains particularly to a playing disc.

Many games played today employ a disc which is thrown back and forth or sailed back and forth between players. These are usually in the form of an inverted saucer. The common discs are constructed of a metal or hard plastic and while usually light in weight can injure a person struck thereby. For this reason the disc must be thrown only outdoors as such, can be somewhat hazardous and can damage furniture and the like within a household.

Fairly soft discs have been known and one is shown for example, in U.S. Pat. No. 4,115,946 issued Sept. 26, 1978. This disc, however, is extremely soft and requires a weighted rim in order to be capable of aerodynamic flight.

It is therefore desirable that an improved disc be available for playing purposes.

SUMMARY AND OBJECTS OF THE INVENTION

It is the primary object of the present invention to provide an improved playing disc.

In accordance with the present invention a playing disc is constructed of a material such as carpeting formed in a cup shape providing upstanding piles to provide an aerodynamically stable and non-hazardous disc.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
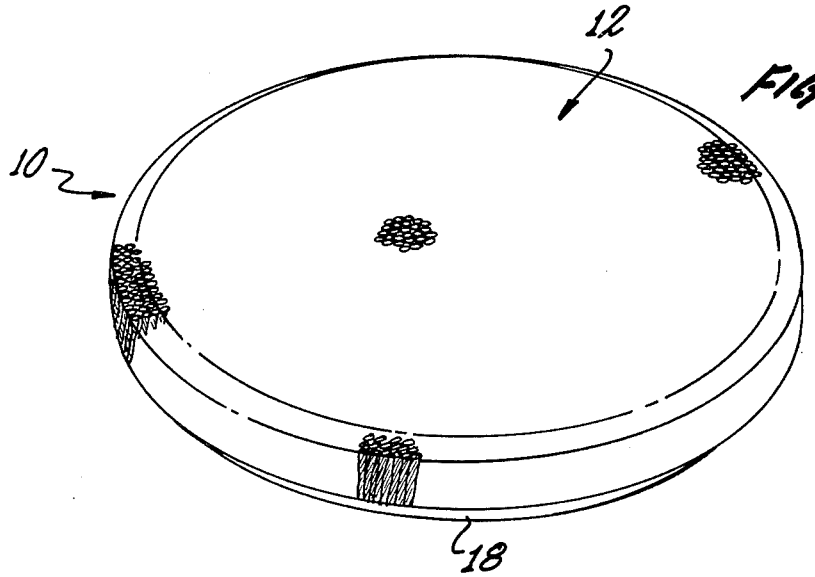
FIG. 1 is a perspective view of a disc in accordance with the invention.
Figure 2:
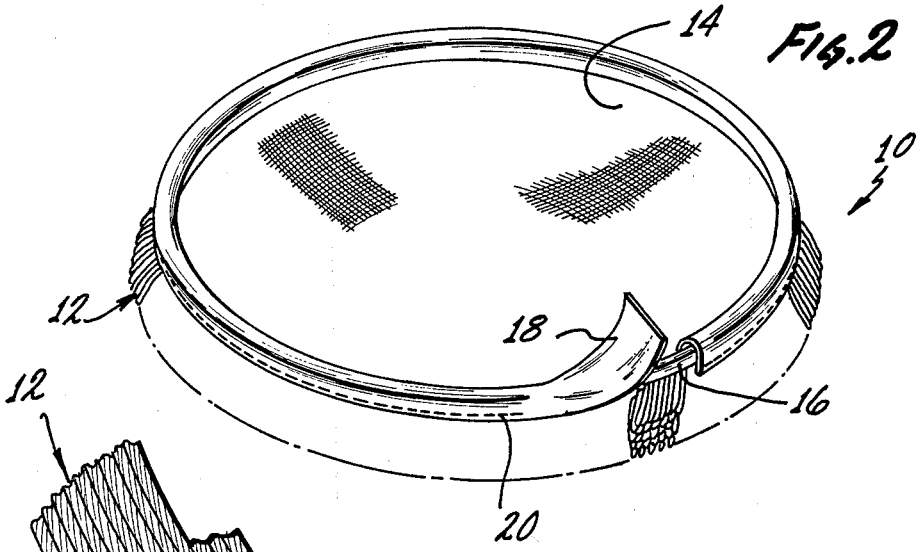
FIG. 2 is a perspective bottom view of the disc of FIG. 1.

Turning to FIG. 1 of the drawings there is illustrated a disc in accordance with the invention, designated generally by the numeral 10, having a generally circular saucer or slightly cup shape. The disc 10 is formed somewhat along the lines of a portion or segment of a sphere and having an upper surface 12, that is of such a nature as to prevent laminar flow of fluid (i.e. air) thereacross. The roughened upper surface provides a turbulent flow of air across the upper surface and thus provides a stable aerodynamic configuration. The disc is constructed of a flexible non-resilient sheet of material such as carpeting.

The lower cup shaped bottom portion of the device similarly adds stability of the device. In addition the disc is preferably constructed of a material such as carpet such that the upper surface is formed to have a pile with the under body 14 of the device formed of the carpet woven body portion. While the thickness and density of the pile can vary, a deep thick pile is preferred. The characteristics of the disc will vary somewhat with variations in the pile. The edge 16 of the disc member is secured by a strip of binding 18, (such as carpet binding) which is sewn around and draws the edges in and forms the generally cup or saucer shape. With this configuration the disc is found to have a very stable structural configuration and is aerodynamically stable to provide a rather true or stable trajectory. The device has sufficient weight and structural integrity that it can be easily tossed for a reasonable distance. The aerodynamic stability of the device and its configuration gives the device sufficient lift to enable a player to obtain reasonable distances upon tossing the disc.

The material of the device is such that it is soft yet stable, and has sufficient body to maintain its structural shape. The softness of the device is such that should it strike a person, no damage or injury would occur. In addition, the device can be rolled up and easily carried or placed in a pocket or the like without damage to it. In addition the device can be played indoors with the device being of sufficient softness that damage to furniture, walls, and the like will not occur.

As previously discussed, the disc is preferably made from a section or segment of carpet having a fairly thick upstanding pile. With this arrangement, the upper surface has sufficient roughness to prevent laminar flow of air across such that the device becomes essentially aerodynamically stable. The roughened upper surface created or defined by the upper ends of the piling will induce turbulence upon passing through the air and thus stabilize the disc.

Figure 3:
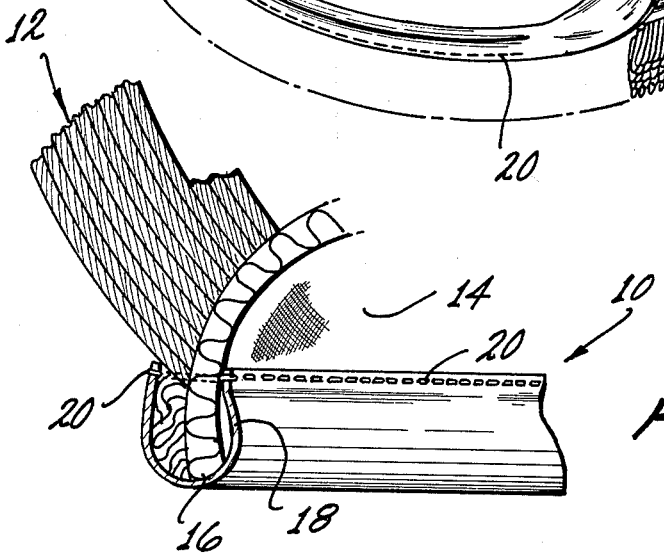
FIG. 3 is an enlarged sectional view of a portion of the disc showing details of construction.

The binding 18 as shown in detail in FIG. 3 is folded over the edge 16 of the carpet section and stitched by stitching at 20. The binding is drawn up to pull the edges down to form the cup shape.

While I have illustrated and described my invention by means of specific embodiments, it is to be understood that numerous changes and modifications may be made therein without departing from the spirit and scope of the invention as defined in the appended claims.

I claim:

1. A disc shaped playing device comprising a circular section of a flexible sheet of carpeting material having a backing and a piling extending from one surface of the backing and having a strip of flexible carpet binding tape tensioned, extending and secured around the periphery of the sheet so that the edges thereof are crimped under for holding the sheet in a slightly cupped shape with a concave surface and a convex surface with the piling extending from the convex surface.

2. The disc shaped playing device of claim 1 wherein the sheet of carpeting material is of the type having a woven backing and said piling extends solely from one surface.

3. The playing device of claim 2 wherein said sheet of carpeting is of the deep pile type.

4. The playing device of claim 2 wherein said sheet of carpeting is of the shag type.

* * * * *